United States Patent [19]

Barnes

[11] 4,031,270

[45] * June 21, 1977

[54] METHOD OF FLOCKING METAL ARTICLES

[75] Inventor: Tracy W. Barnes, Peoria, Ill.

[73] Assignee: Laidlaw Corporation, Peoria, Ill.

[ * ] Notice: The portion of the term of this patent subsequent to Dec. 18, 1990, has been disclaimed.

[22] Filed: June 2, 1975

[21] Appl. No.: 582,912

Related U.S. Application Data

[60] Continuation of Ser. No. 477,796, June 10, 1974, abandoned, which is a division of Ser. No. 314,138, Dec. 11, 1972, Pat. No. 3,850,659.

[52] U.S. Cl. ..... 427/27; 118/309; 118/634; 427/33; 427/206; 361/225

[51] Int. Cl.² ..... B44C 1/08; B05B 5/02; B44D 1/092

[58] Field of Search ..... 427/25, 26, 27, 30, 427/32, 33, 206; 317/3; 118/309, 634

[56] References Cited

UNITED STATES PATENTS

| | | | |
|---|---|---|---|
| 1,788,600 | 1/1931 | Smyser | 427/25 |
| 2,173,032 | 9/1939 | Wintermute | 427/26 |
| 2,174,328 | 9/1939 | Meston et al. | 118/629 |
| 2,419,435 | 4/1947 | Behr | 223/88 |
| 2,435,111 | 1/1948 | Wahl | 223/88 |
| 2,572,534 | 10/1951 | Summer | 223/88 |
| 2,605,030 | 7/1952 | Fischer | 223/8 |
| 2,806,803 | 9/1957 | Thackara et al. | 427/33 X |
| 2,866,583 | 12/1958 | Batts | 223/88 |
| 2,889,805 | 6/1959 | Freeder | 118/627 |
| 3,059,824 | 10/1962 | Henry | 223/88 |
| 3,157,324 | 11/1964 | Barnes | 223/88 |
| 3,218,184 | 11/1965 | Lemelson | 427/185 |
| 3,225,980 | 12/1965 | Wieckmann | 223/88 |
| 3,323,933 | 6/1967 | Barford et al. | 427/25 |
| 3,348,745 | 10/1967 | Basile et al. | 223/88 |
| 3,425,604 | 2/1969 | Mauldin | 223/88 |
| 3,460,726 | 8/1969 | Rooz | 223/95 |
| 3,646,909 | 3/1972 | Cole et al. | 118/629 |
| 3,716,024 | 2/1973 | Pierson | 427/27 X |
| 3,850,659 | 11/1974 | Barnes | 427/33 |
| 3,853,581 | 12/1974 | Fabre | 427/33 |
| 3,919,437 | 11/1975 | Brown et al. | 427/32 X |

*Primary Examiner*—Ronald H. Smith
*Assistant Examiner*—Shrive P. Beck
*Attorney, Agent, or Firm*—Allegretti, Newitt, Witcoff & McAndrews

[57] ABSTRACT

A method for flocking a wire garment hanger in which electrostatically-charged fibrous flock particles are applied to an adhesive film on a portion of the hanger and the hanger is immediately heated to set the adhesive while the fibers remain radially oriented on the wire. The invention also contemplates blowing air sequentially on various portions of the surface of a bed of flock to cause the fibers to become suspended in air above the bed, through which suspension the hangers are passed.

7 Claims, 6 Drawing Figures

METHOD OF FLOCKING METAL ARTICLES

This is a continuation of application Ser. No. 477,796 filed June 10, 1974, and now abandoned, a division of Ser. No. 314,138 filed Dec. 1, 1972 now U.S. Pat. No. 3,850,659.

This invention relates to a method for flocking wire garment hangers and similar metal objects, and more particularly to a method of adhering fibrous particles to a selected portion of the wire from which the hanger is formed. Wire garment hangers frequently have a paper sleeve or cover over the lower horizontal stretch portion of the hanger to increase the diameter of the wire thus preventing creasing a garment draped over the wire. One of the objects of this invention is to provide low cost substitute covering of fibers which project from the wire surface to provide a clean non-slip, non-creasing surface over which a garment may be hung.

It has been proposed heretofore to flock metal articles by blowing or spraying fibers on an adhesive applied to the surface of the article. But this method has not been completely satisfactory because the flock which consists of short fibers tend to clog the spray nozzle. Cellulose fibers particularly are not free flowing but have a tendency to interlock and become compacted which makes them difficult to convey in an air stream. In the present invention, a film of liquid adhesive is applied to the portion of the wire hanger to be flocked. The hanger is then passed through an enclosed space in which the flock is suspended in air whereupon the fibers adhere to the still-wet adhesive. Preferably the fibers are charged electrostatically of one polarity and the metal hanger is charged oppositely so that the fibers are attracted to the wire surface oriented on radii of the round wire. The metal hanger is immediately heated to dry the adhesive. It is important that this heating step be carried out promptly so that the fibers do not become saturated with the adhesive and flatten out in the liquid adhesive, rather than being disposed with their ends projecting outwardly from the adhesive-coated surface.

The invention generally lies in the method steps which cooperate to produce a wire hanger having a soft flocked portion.

More particularly, the present invention is directed to the method and means for producing an environment containing fibers suspended in air through which the metal article is passed to cover the adhesive film with the fibers standing on end. It has been discovered that if streams of air are passed upwardly through a bed of cellulose flock or directed against the surface of the bed, the fibers will become entrained in the air stream for a short time. However, as the stream continues to flow, it forms fissures in the bed. The fibers interlock and pack on the surface of the fissures to provide a channel through which the air flows without lifting fibers from the bed. I have discovered that if a plurality of air nozzles are operated intermittently for a very short period of time, say 1–2 seconds, the formation of fissures can be avoided. One nozzle or a group of nozzles may be directed at a particular area of the fiber bed surface and another nozzle or group of nozzles disposed opposite the first set may be directed at another adjoining area of the surface. Air from the first nozzle or group of nozzles causes the fibers to be lifted from the surface of the bed and entrained in the air above the bed. After a couple of seconds of operation, the first set of nozzles is shut off and simultaneously the second set comes into operation. By this means, the air above the bed becomes filled with fibers. Preferably the fibers are electrostatically charged as they rise from the bed by causing them to pass through a charged grid-type electrode overlying the bed.

The invention may be understood from the following detailed description and the accompanying drawings in which:

FIG. 1 is a perspective semi-diagrammatic view of apparatus which may be used in accordance with the invention for flocking garment hangers made from wire.

FIG. 1*a* is an enlarged view of a hanger prepared in accordance with the invention and comprises the portion within the circle designated 1*a* in FIG. 1.

Figure 1:
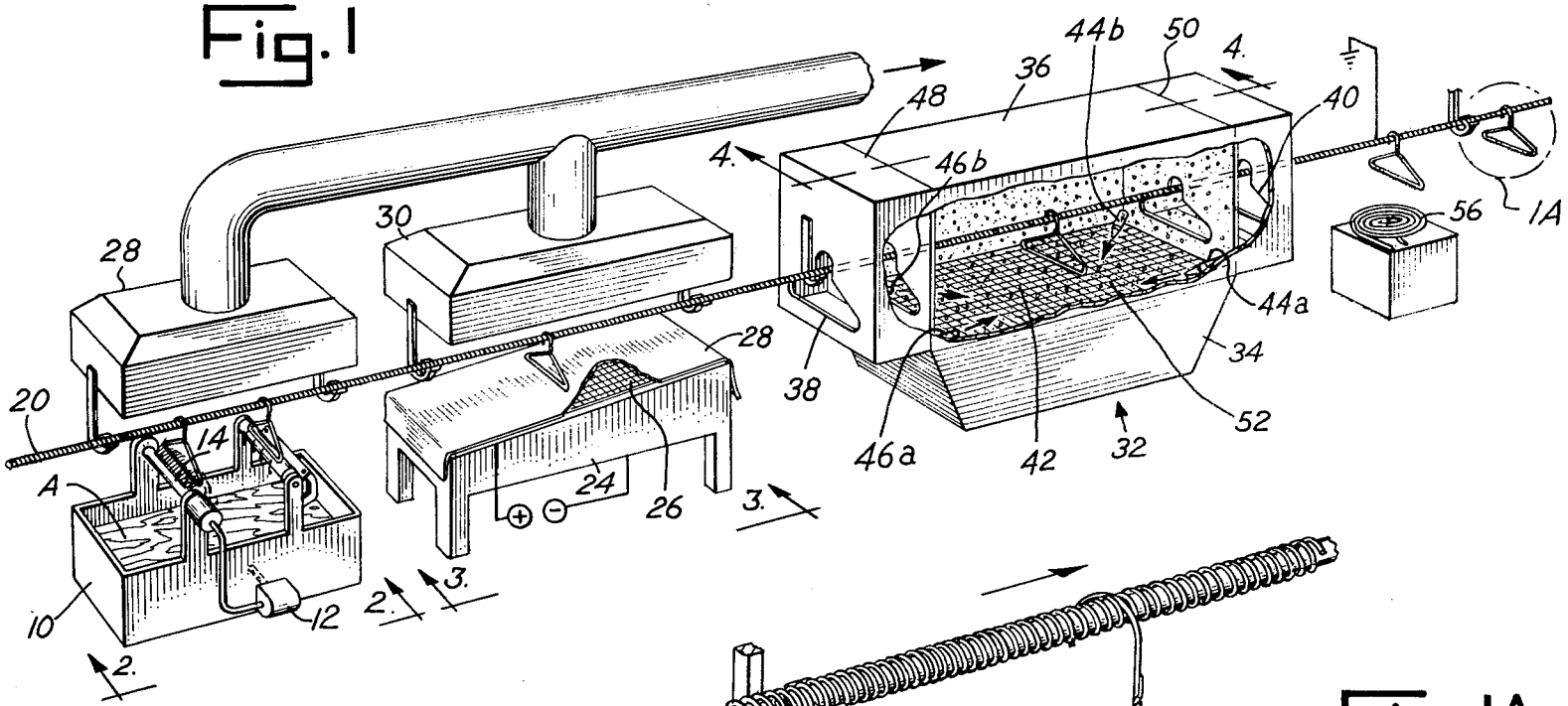
Figure 1A:
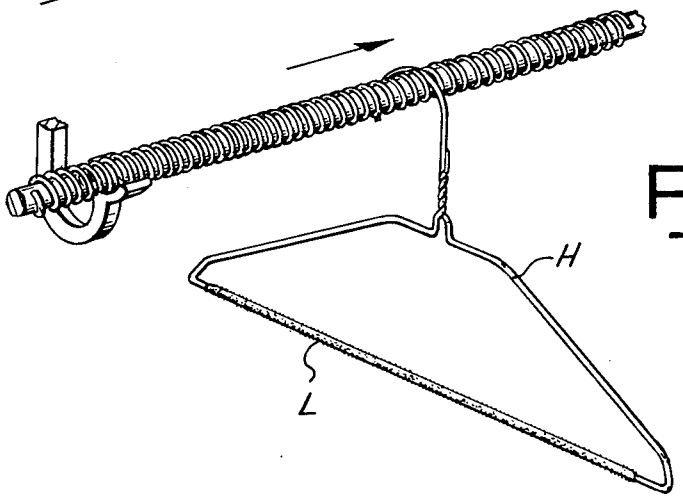
Figure 2:
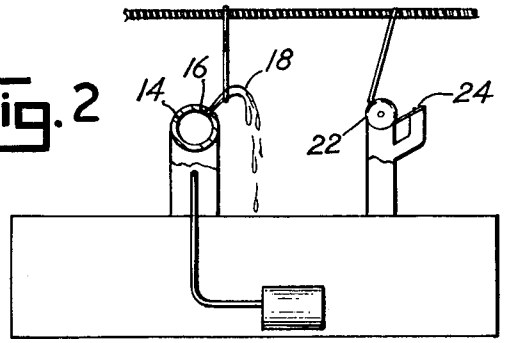
FIG. 2 is a front elevational view taken along the line 2—2 illustrating the apparatus for applying the adhesive to the horizontal stretch of the hanger.
Figure 3:
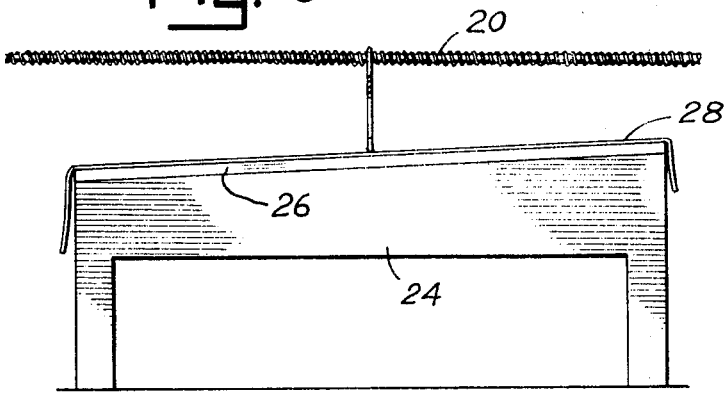
FIG. 3 is a front elevational view taken along the line 3—3 of FIG. 1 illustrating the detearing apparatus for removing excess adhesive from the wire.

A suitable adhesive A for adhering the flock to the wire is provided in the vat 10 equipped with a pump 12 which moves the adhesive into the pipe 14 having a slot 16 extending longitudinally thereof. The adhesive is expelled through the slot 16 to provide a fountain 18 of adhesive through which the horizontal lower stretch portion L of the hanger H passes as the hanger H advances along the rotating worm conveyor 20. The adhesive falls back into the vat and is recirculated by the pump. A rotating cylinder 22 mounted above the surface of the vat 10 is provided for removing the excess adhesive which drips down from the wire portion L. The cylinder 22 is driven by any suitable means and a doctor blade 24 is in contact with the surface to scrape off the adhesive to prevent build up of the adhesive on the surface.

An electrostatically detearing apparatus 24 having a charged grid 26 is provided just downstream of the adhesive vat 10. Any adhesive drips on the underside of the wire L and is removed by this apparatus. This is a standard piece of equipment commonly used for detearing. The grid 26 is inclined upwardly toward the downstream end of the apparatus to avoid concentration of the electrical charge at the edge of the grid. The grid is covered with paper 28 which may be replaced periodically as it becomes laden with adhesive. The paper prevents the adhesive removed from the wire L from building up on the grid 26.

A pair of hoods 28, 30 are provided above the adhesive vat 10 and the detearing apparatus 24 to remove from the room solvent which volatilizes from the adhesive during the coating operation. The wire hangers are advanced through the apparatus by means of a rotating worm 20 which cooperates with the hook on the hanger.

The flocking apparatus 32 has a hopper-like bottom 34 filled with a mass of flock. The upper portion of the apparatus is enclosed with a transparent plastic cover 36 having cut-out portions 38, 40 at opposed ends to permit the hanger H on the conveyor to pass through the enclosed space 42. This space is filled with flock entrained in the air by means of nozzles 44*a*, 44*b*, 46*a*, 46*b* disposed at the four corners of the hopper 34 and which direct air against the bed of fibers in the hopper. Panels 48 and 50 are provided within the enclosure to form vestibules at the entrance and exit thereby reducing the tendency of the flock to escape from the enclosure into the room. The vestibules are connected to an exhaust system. A grid 52 connected to an electrostatic generator is provided above the surface of the hopper to electrostatically charge fiber particles which rise upwardly therethrough in the air streams provided by the nozzles 44, 46. The conveyor screw 20 is grounded so that the hangers in electrical connection therewith are oppositely charged to the particles and, therefore, attract the particles from the air as the hangers pass through the space 42. The electrostatic charge causes the fibers to stand on end, radially of the wire L.

In order to dry the adhesive quickly and lock the fibers in place, I have provided an induction coil 56 just downstream of the flocking apparatus 32. As the wire hangers pass over the coil, a current is induced in the metal which causes it to heat instantaneously and dry the adhesive. It is important to carry out this heating step promptly after the flock has been applied to the adhesive. If the fibers remain in contact with the liquid adhesive for more than a few minutes, the adhesive will wick along the length of the fiber and cause it to lie flat within the adhesive film. For maximum efficiency in operation, the fibers should be standing on end.

Figure 4:
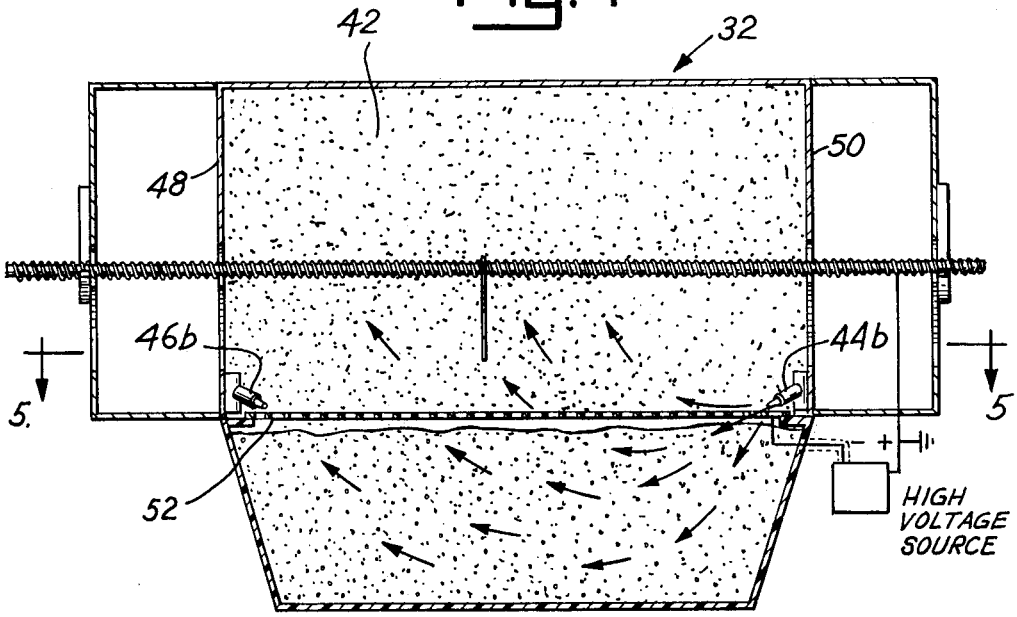
FIG. 4 is a sectional view taken along the line 4—4 of FIG. 1, showing the flocking enclosure.
Figure 5:
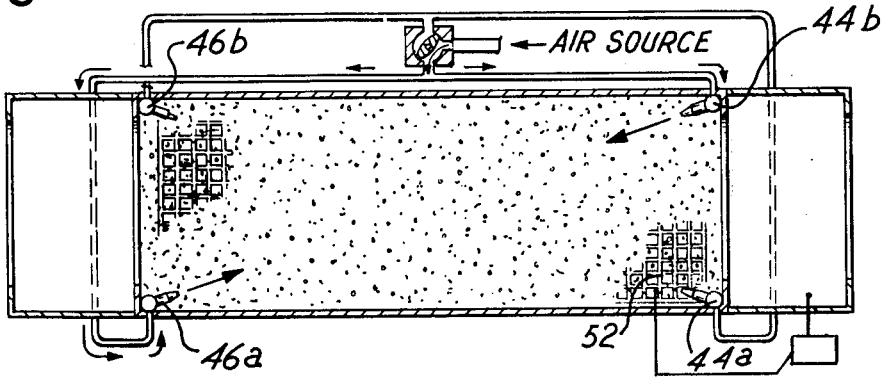
FIG. 5 is a top sectional view taken along the line 5—5 of FIG. 4.

The flocking apparatus 32 is operated in an intermittent fashion to prevent fissures from forming in the fiber bed as illustrated in FIGS. 4 and 5. The fibers useful for purposes of the invention may be made from rayon, 6 denier weight, and averaging about 0.045 inch in length. These fibers mat together and become compacted under the force of air. Once compacted, it is extremely difficult to break up the fibers into individual particles. I have found that by expelling air from diagonally opposed nozzles 44*b* and 46*b* simultaneously while shutting off the air to the corresponding nozzles 44*b* and 46*a*, the fibers can be lifted from the surface of the bed and entrained in the air within the space 42. The air is expelled for only a second or so and this length of time is not sufficient to cause the fissures to form. At the time nozzles 44*a* and 46*b* are shut off, the remaining nozzles in the other corners of the apparatus are turned on, thus causing a different area of the flock bed to be subjected to the air streams. Some of the fibers which are lifted by nozzles 44*b* and 46*a* are deposited in the path of the nozzles 44*a* and 46*b* whereupon they are lifted during the next blast of air coming from these nozzles. In this way, the entire surface of the flock bed is being agitated to cause continual shifting of the fibers so that fissures do not form. The intermittent blasts of air from opposed nozzles seem to be responsible for the fact that the fibers do not become compacted. If desired or necessary to work the entire surface area of the bed, the nozzles may be mounted to oscillate rather than stationary.

The adhesive A is prepared from thermosetting resin containing a white pigment dissolved in a suitable solvent such as an aromatic hydrocarbon. The resins used in the adhesive, such as a mixture of a minor proportion of polyvinyl chloride in a thermosetting alkyd are selected so that they will set up at about 300° F. and will not soften below that temperature after setting.

It will be appreciated that by following the teaching of the present invention, the adhesive is placed precisely where it is desired. The tearing at the corners is eliminated by using the electrostatic device 24. The flock is applied uniformly with the fibers standing on end by reason of the electrostatic charge imparted to the fibers as they are entrained in the air in the apparatus 32. The induction heating apparatus 56 provides the prompt rise in temperature required to set the adhesive film immediately and lock the fibers into place. If desired, a means for knocking the hanger to shake off fibers other than those deposited on the adhesive may be provided. As the hanger passes through the enclosure 42, some of the fibers are collected on the wire which is not coated with adhesive and it is desirable to shake these fibers off before the hangers are packed for shipment.

Having described my invention, I claim:

1. A method for distributing and charging a flock material within an enclosure in order to apply said material to an electrically charged, adhesive coated coat hanger suspended in said enclosure comprising the steps of:

a. providing an enclosure containing a mass of flock material fibers with a mass surface and electrode means for imparting an electrostatic charge of a first polarity to said fibers, said hanger being suspended above the mass surface and being provided with a charge of opposite polarity, b. directing a plurality of separate air streams intermittently for short time periods against the mass of flock material to lift fibers from the mass, entrain them in the air and carry them past the electrode means for imparting the charge of said fibers, thereby at least partially filling the space above said mass with charged fibers of the first polarity, and c. depositing the fibers on the oppositely charged hanger.

2. Apparatus for distributing and charging a flock material for coating said material on a surface of a coat hanger within said apparatus comprising, in combination:

an enclosure having at least one opening for access by the hanger and a lower portion for receipt of a mass of flock material defining a mass surface;

an electrode above the mass within the enclosure for imparting an electrostatic charge to fibers of said flock material;

a plurality of air stream discharge means directed at said mass; and means for intermittently operating separate ones of said air stream discharge means for short periods of time to dislodge fibers from the mass to be entrained and carried in the air within the enclosure.

3. A method for distributing and charging a flock material within an enclosure comprising the steps of:

a. providing an enclosed space containing a mass of flock material fibers with a mass surface and electrode means for imparting an electrostatic charge of a first polarity to said fibers, and b. directing a plurality of separate air streams intermittently for short time periods against the mass of flock material to lift fibers from the mass, entrain them in the air and carry them past the electrode means for imparting the charge to said fibers, thereby at least partially filling the space above said mass with charged fibers of the first polarity.

4. The method of claim 3 including the step of selectively operating opposed sources for said air streams intermittently so that different areas of said mass surface are acted upon at differed times.

5. Apparatus for distributing and charging a flock material for coating said material on a surface of an article within said apparatus comprising, in combination:

an enclosure having at least one opening for access by the article and a lower portion for receipt of a mass of flock material defining a mass surface;

an electrode above the mass within the enclosure for imparting an electrostatic charge to fibers of said flock material a plurality of air stream discharge means directed at said mass; and means for intermittently operating separate ones of said air stream discharge means for short periods of time to dislodge fibers from the mass to be entrained and carried in the air within the enclosure.

6. The apparatus of claim 5 including means for charging said article within the enclosure with a polarity distinct from the charge imparted to fibers.

7. The apparatus of claim 5 including entrance vestibules for the opening for access to the enclosure, said vestibules serving to reduce escape of flock fibers from the enclosure.

* * * * *